US007072828B2

(12) United States Patent
Petty

(10) Patent No.: US 7,072,828 B2
(45) Date of Patent: Jul. 4, 2006

(54) APPARATUS AND METHOD FOR IMPROVED VOICE ACTIVITY DETECTION

(75) Inventor: Norman W. Petty, Columbia Falls, MT (US)

(73) Assignee: Avaya Technology Corp., Basking Ridge, NJ (US)

( * ) Notice: Subject to any disclaimer, the term of this patent is extended or adjusted under 35 U.S.C. 154(b) by 745 days.

(21) Appl. No.: 10/145,370

(22) Filed: May 13, 2002

(65) Prior Publication Data

US 2003/0212548 A1 Nov. 13, 2003

(51) Int. Cl.
*G10L 11/02* (2006.01)

(52) U.S. Cl. ..... 704/210; 704/215

(58) Field of Classification Search ..... 704/201, 704/206, 208, 210, 211, 215
See application file for complete search history.

(56) References Cited

U.S. PATENT DOCUMENTS 3,909,532 A * 9/1975 Rabiner et al. ..... 704/215
4,053,712 A * 10/1977 Reindl ..... 704/215
4,110,560 A * 8/1978 Leary et al. ..... 704/214
4,376,874 A * 3/1983 Karban et al. ..... 704/215
4,449,190 A * 5/1984 Flanagan et al. ..... 706/22
4,696,039 A * 9/1987 Doddington ..... 704/215
5,579,431 A * 11/1996 Reaves ..... 704/214
5,790,538 A 8/1998 Sugar
5,890,109 A * 3/1999 Walker et al. ..... 704/215
6,157,653 A 12/2000 Kline et al.
6,161,087 A * 12/2000 Wightman et al. ..... 704/215
6,256,606 B1 * 7/2001 Thyssen et al. ..... 704/221
6,259,677 B1 7/2001 Jain
6,490,556 B1 * 12/2002 Graumann et al. ..... 704/233
6,535,844 B1 * 3/2003 Wood et al. ..... 704/210
6,711,536 B1 * 3/2004 Rees ..... 704/210
6,725,191 B1 * 4/2004 Mecayten ..... 704/215
2003/0223443 A1 * 12/2003 Petty ..... 370/412
2003/0225573 A1 * 12/2003 Petty ..... 704/205

* cited by examiner

*Primary Examiner*—Martin Lerner
(74) *Attorney, Agent, or Firm*—John C. Moran

(57) ABSTRACT

Problems of front-end clipping and excessively long hold-over times in digitally encoded speech are resolved by the introduction of a queue at the transmitting end of a digital conversation. Samples are transmitted from the queue until an interval of low energy samples is encountered upon which time samples are not transmitted from queue until energy samples are present.

3 Claims, 6 Drawing Sheets

APPARATUS AND METHOD FOR IMPROVED VOICE ACTIVITY DETECTION

TECHNICAL FIELD

This invention relates to the transmission of digitally encoded voice, and in particular, to the transmission of digitally encoded voice so as to maintain speech quality.

BACKGROUND OF THE INVENTION

Because of the popularity of the Internet, a growing need for remote access, and the increase in data traffic volume that has exceeded the voice traffic volume through the voice and data communication networks, the transmission of voice as data rather than circuit switched voice is becoming more important. The problem that exists when voice is transmitted as data such as voice-over-packet technology or voice-over-the-Internet is to guarantee the quality of service. To reduce the bandwidth required to carry voice, voice-over-packet systems employ a voice activity detection to suppress the packetization of voice signals between individual speech utterances such as the silent periods in a voice conversation. Such techniques adapt to varying levels of noise and converge on appropriate thresholds for a given voice conversation. Use of voice activity detection reduces the required bandwidth of an aggregation of channels 50% to 60% for conversations that are essentially half-duplex, only one person speaks at a time in a half-duplex conversation.

When silence suppression is being used, a noise generator at the receiving end compliments the suppression of silence at the transmitting end by generating a local noise signal during the silent periods rather than muting the channel or playing nothing. Muting the channel gives the listener the unpleasant impression of a dead line. The match between the generated noise and the true background noise determines the quality of the noise generator.

Within the prior art, it is welt known that voice activity detection to determine silence and the removal of those silent periods can cause speech utterances to sound choppy and unconnected when cutting in or out of the speech. Two terms are utilized to express this problem. First, front-end clipping refers to clipping the beginning of an utterance. Second, holdover time refers to the time the activity detector continues to packetize speech after the voice signal level falls below the speech threshold. The holdover time is normally set to the period between words as has been determined for a particular conversation so as to avoid front-end clipping at the beginning of each word. However, excessive holdover times reduce network efficiency and too little causes speech to sound choppy.

SUMMARY OF THE INVENTION

This invention is directed to solving these and other problems and disadvantages of the prior art. In an embodiment of the invention, the problems of front-end clipping and excessively long holdover times is resolved by the introduction of a history queue at the transmitting end of the digital conversation.

GENERAL DESCRIPTION

Problems of front-end clipping and long holdover times are resolved by the introduction of a history at the transmitting end. The history queue is equal in length to the normal front-end clipping time. That is to say that there are sufficient samples in the history queue to equal the normal time that would be devoted to front-end clipping. When the speech threshold is reached indicating silence, the transmitter no longer transmits packets to the receiving end of the conversation. However, the speech samples being generated indicating silence or voice are continuously stored in the history queue. However, it should be realized that only the last period of time of the speech is stored in the history queue during this period of operation. When the speech threshold is reached indicating the transition from silence to voice, the transmitter begins once again to remove samples from the history queue and transmit packets to the receiving end of the voice conversation. Since the history queue includes the normal front-end clipping time of samples prior to the detection of voice, the transition from silence to speech appears to the listener to be excellent since this transition includes the normal front-end clipped speech. Advantageously, not only is the front-end clipping problem resolved, but the holdover time that is allowed for the determination of silence can be reduced. Advantageously, this method and apparatus greatly increases the efficiency of the transmission of voice through a packetized system.

DETAILED DESCRIPTION

Figure 1:
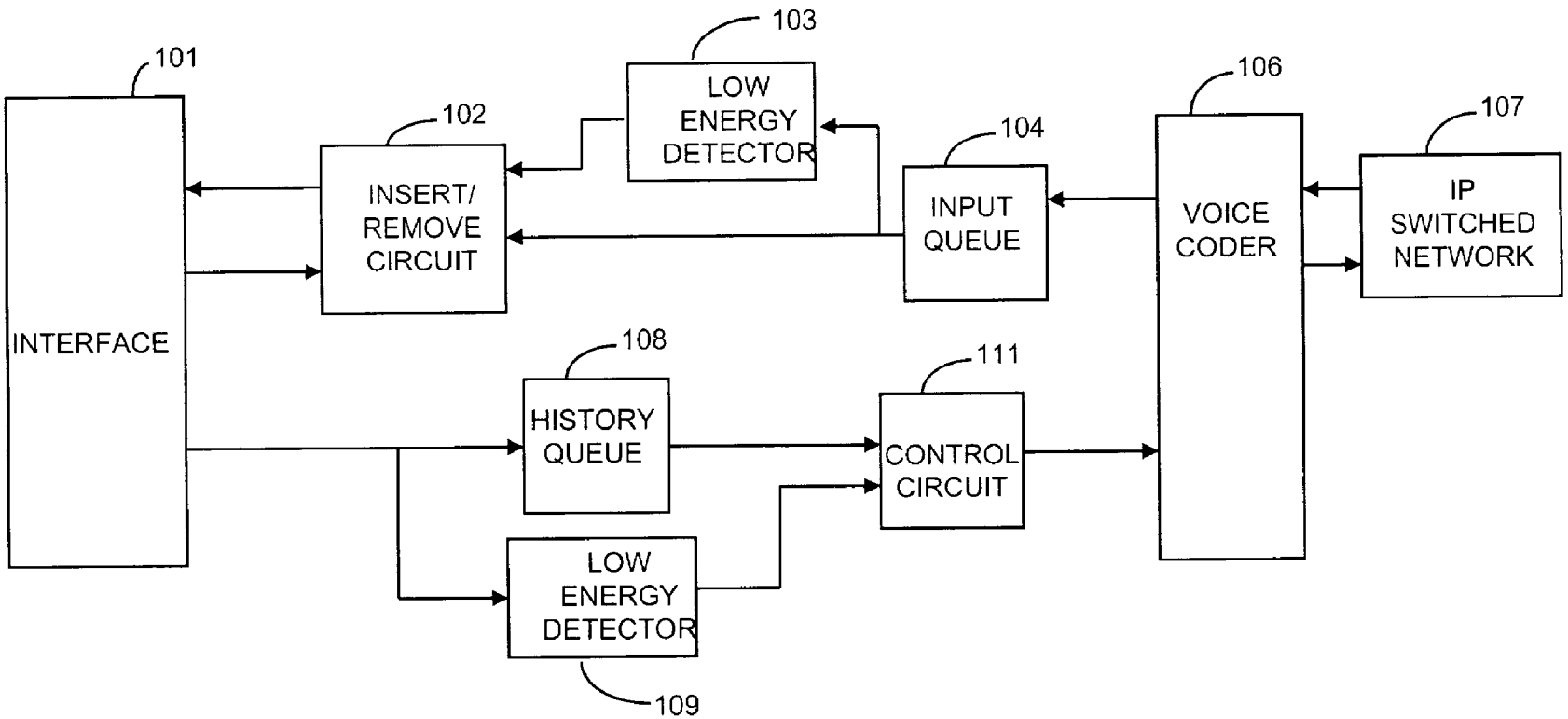
FIG. 1 illustrates an embodiment of the invention.

FIG. 1 illustrates a system for implementing an embodiment of the invention. Synchronous physical interface 101 is exchanging digital samples with IP switched network 107 via voice encoder 106. Voice samples being received from IP switched network 107 are received by voice coder 106 and processed by elements 102–104 before being transferred to interface 101 in a manner well known by those skilled in the art. This processing allows insert/remove circuit 102 to maintain a steady synchronous stream of voice samples to interface 101 in accordance with the requirements of interface 101.

Interface 101 is also transmitting a steady synchronous stream of voice samples to history queue 108 and low energy detector 109. However, voice coder 106 is packetizing voice samples for transmission to the receiving end of the voice conversation via IP switched network 107. The number of samples stored in history queue 108 is equal to the holdover time between utterances that has been determined for the user of the system that is speaking into a microphone not shown that eventually communicates voice samples to interface 101. The length of the queue of history queue 108 would adapt to the speaking characteristics of different users, resulting in the number of samples being processed by history queue 108 varying for individual users and during the conversation for the same user. Low energy detector 109 determines the thresholds that specify the presence of silence or voice activity in the speech samples being received from interface 101. History queue 108 is continuously accepting samples from interface 101 and attempting to transmit these samples to control circuit 111. Control circuit 111 is responsive to a signal from low energy detector 109 indicating that voice activity has been detected in the samples being transmitted from interface 101 to begin to transmit voice samples from history queue 108 to voice coder 106. Voice coder 106 is responsive to the samples being received from control circuit 111 to packetize these samples and transmit them via IP switched network 107. When low energy detector 109 5 determines that the silence has been present in the speech samples for a first predefined amount of time, low energy detector 109 removes the signal being transmitted to control circuit 111 which ceases to transmit samples to voice coder 106. Note, that the first predefined time utilized by low energy detector 109 is now the holdover time that is utilized by the system illustrated in FIG. 1. Advantageously, this holdover time is shorter than what would normally have to be allowed.

Figure 2:
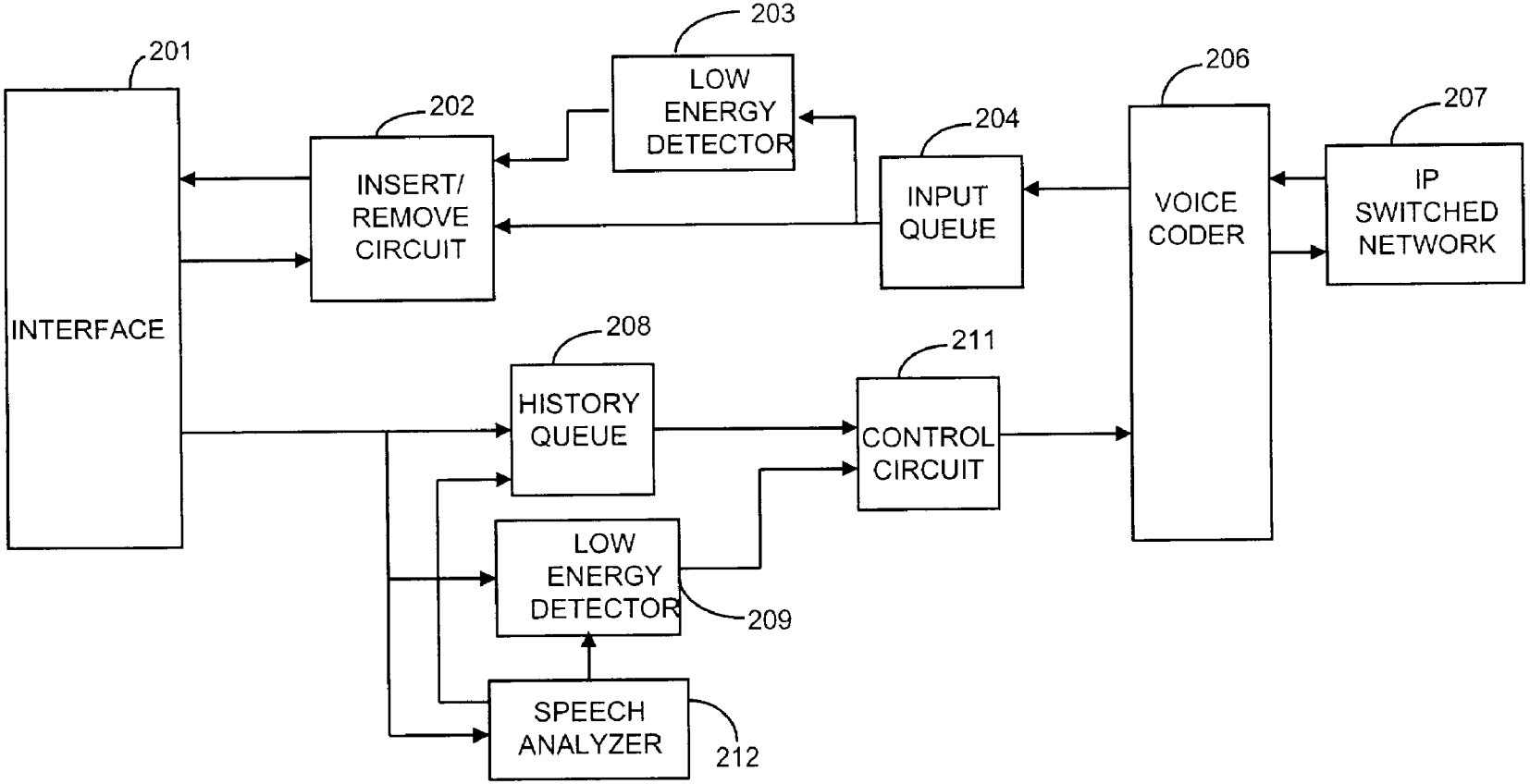
FIG. 2 illustrates an embodiment of the invention.

FIG. 2 illustrates another embodiment of the invention. Elements 201–207 and 211 perform the same operations as those described with respect to FIG. 1 for elements 101–107 and 111. Speech analyzer 212 is responsive to the speech samples being received from interface 201 to determine phonemes and words from the sample. Speech analyzer 212 utilizer well know voice recognition techniques to accomplish the detection of phonemes and words from the speech samples. Speech analyzer 212 than utilizer this information to adjust the length of the queue maintained by history queue 208 to be equal to the amount of time determined between the words actually being receiver in the voice sample from interface 201. Speech analyzer 212 maintains a smoothing technique so as to average out the amount of time between words over a predefined period of time. In addition, speech analyzer 212 utilizer the information concerning phonemes and words to adjust an interval utilized by low energy detector 209 to indicate to control circuit 211 when it is to stop the communication of samples to voice controller 206.

Figure 3:
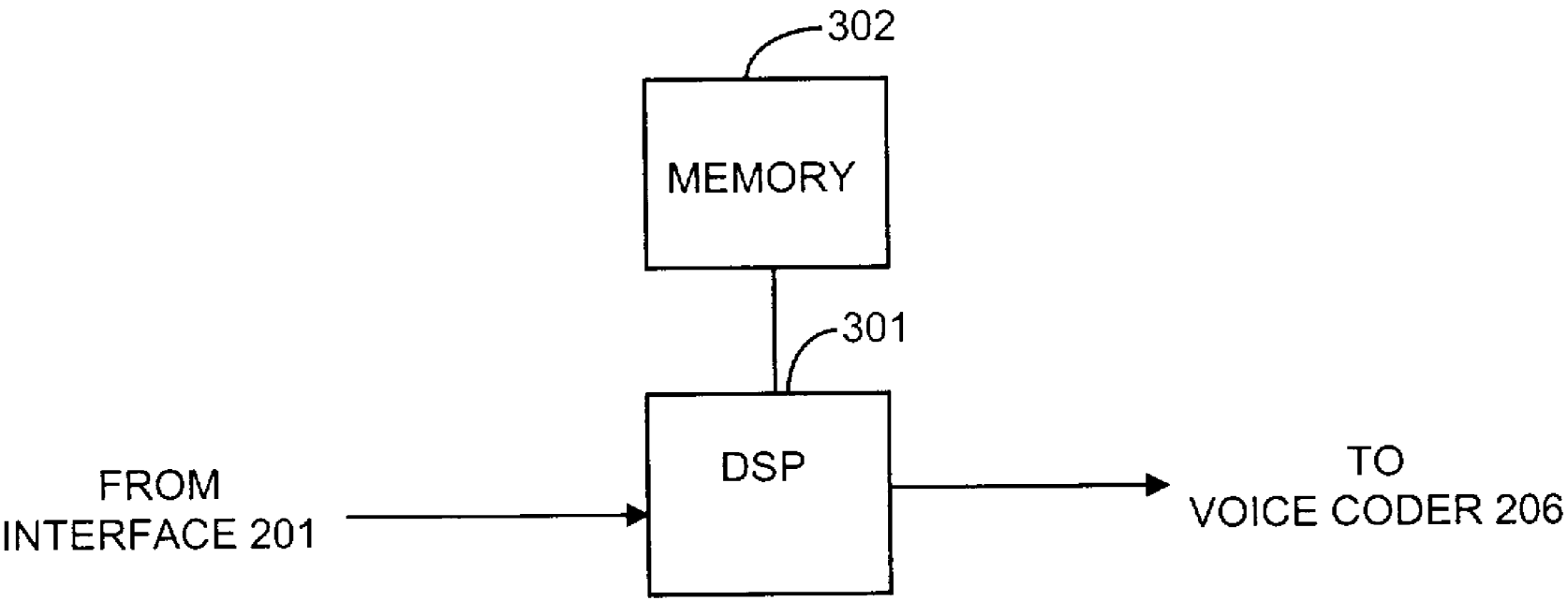
FIG. 3 illustrates an embodiment of the invention.

FIG. 3 illustrates, in block diagram form, a hardware implementation an embodiment of blocks 208–212 of FIG. 2. One skilled in the art would readily realize that all of the elements of FIG. 2 could be combined and their functions be performed in one digital signal processor or multiple digital signal processors could be utilized. Digital signal (DSP) 301 executes a program stored in memory 302 to implement the operations illustrated in FIGS. 5 and 6. One skilled in the art would readily recognize that DSP 301 could be any type of stored program controlled circuit and also could be a wired logic circuit such as a programmable logic array that simply stored data in memory 302. The circuit of FIG. 3 could also implement the operations of blocks 108–111 of FIG. 1 to perform the operations illustrated in FIG. 4.

Figure 4:
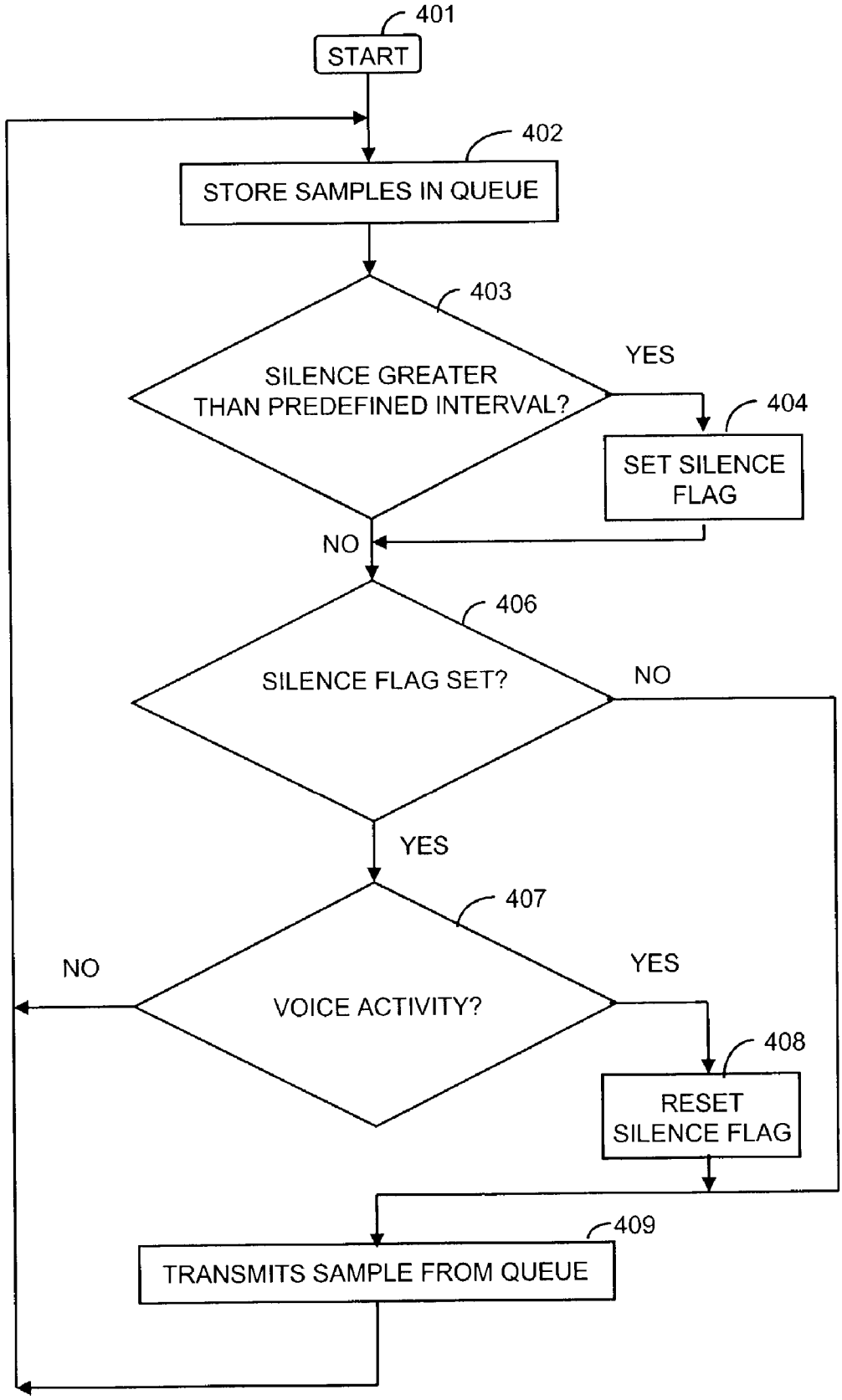
FIG. 4 illustrate, in flow chart form, the steps performed in implementing an embodiment of the invention.

FIG. 4 illustrates the operations to be performed by blocks 108–111 of FIG. 1 in implementing an embodiment of the invention. The operations of FIG. 4 could be performed by a circuit similar to that illustrated in FIG. 3. Once started in block 401, block 402 stores samples in the history queue before transferring control to decision block 403. Decision block 403 is responsive to the energy in the samples that are being stored in queue 402 to determine if a silent interval greater than a predefined interval has occurred. If the answer is yes, block 404 sets the silence flag before transferring control to decision block 406. If the answer in decision block 403 is no, control is transferred to decision block 406 which determines if the silence flag is set. If the answer is no in decision block 406, control is transferred to block 409 which transmits a sample from the history queue to the voice coder before returning control back to block 402. Returning to decision block 406, if the answer is yes that the silence flag is set, decision block 407 determines if the low energy detector has detected any voice activity. If the answer is no, control is transferred back to block 402. If the answer in decision block 407 is yes, control is transferred to block 408 which resets the silence flag before transferring control to block 409.

Figure 5:
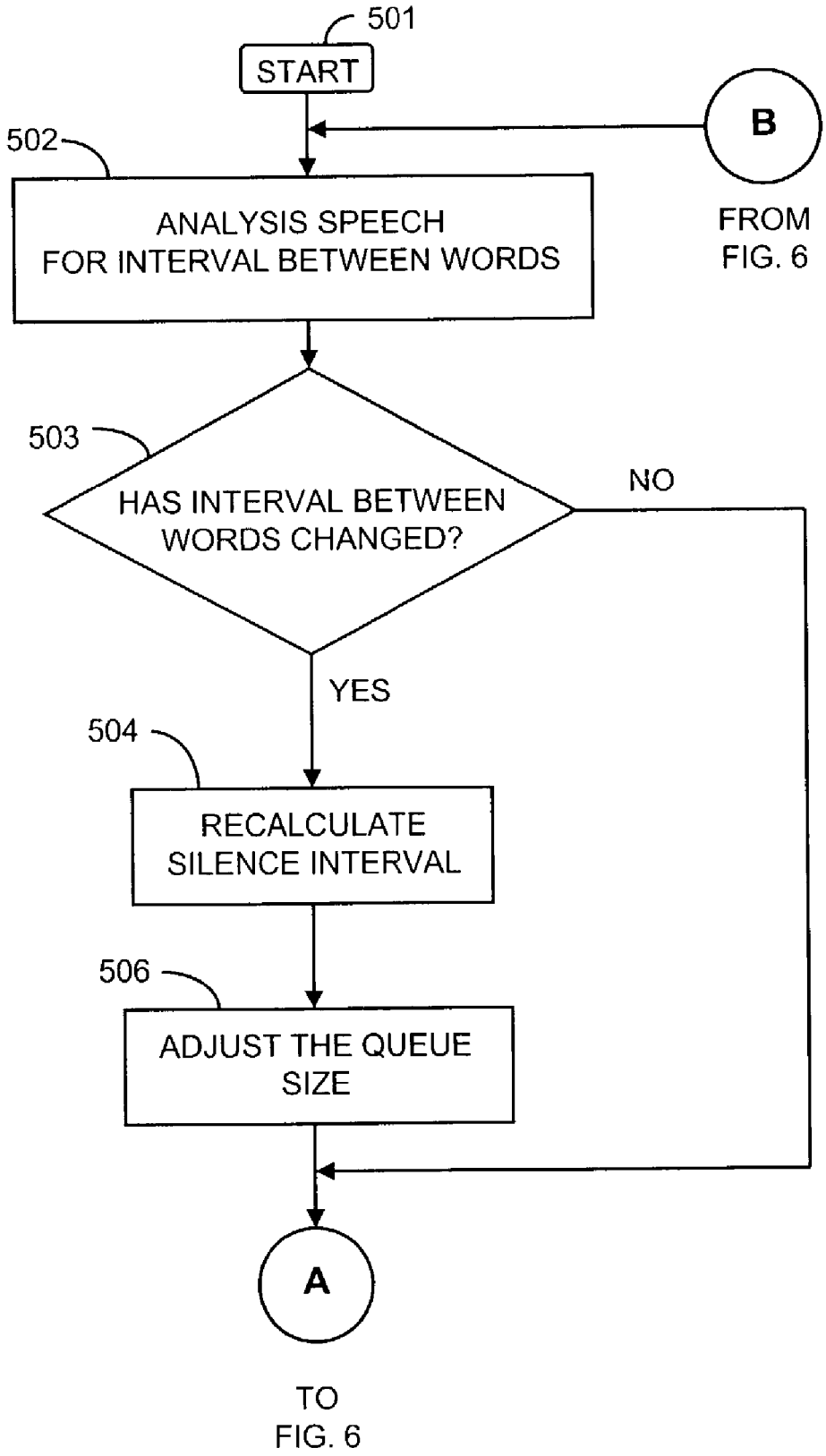
FIGS. 5–6 illustrate, in flow chart form, the steps performed in implementing another embodiment of the invention.
Figure 6:
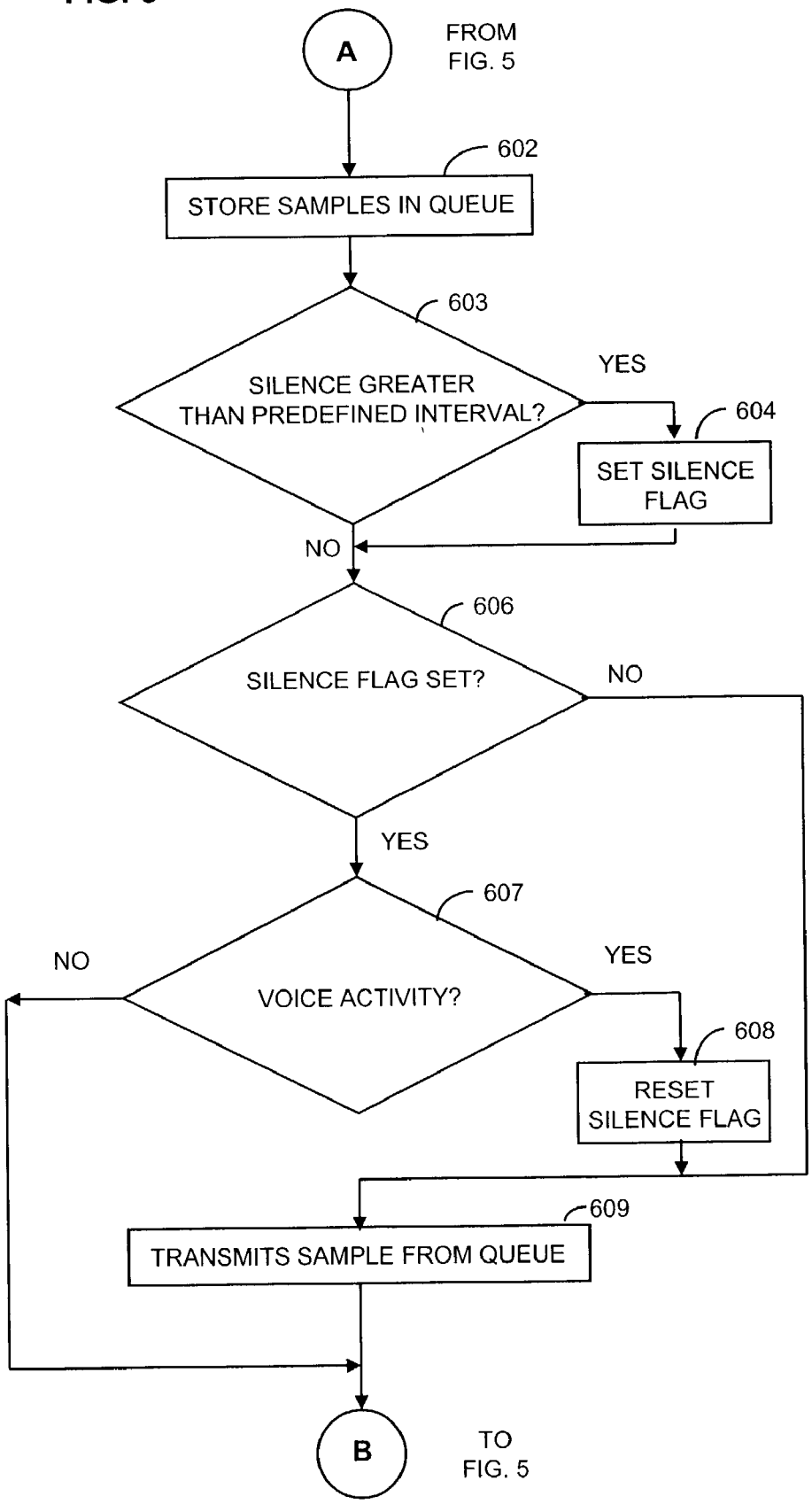

FIGS. 5 and 6 illustrate, in flowchart form, the steps performed by speech analyzer 212. After being started in block 501, block 502 analyzes the incoming speech to determine the interval between words using well known techniques. After execution of block 502, decision block 503 determines if the interval between the words has changed. If the answer is no, control is transferred to block 602 of FIG. 6. If the answer is yes in decision block 503, block 504 recalculates the silence interval, and block 506 adjusts the queue size before transferring control to block 602 of FIG. 6.

One skilled in the art would readily realize that the analysis for speech and the recalculation of the silence interval and the adjustment of the queue size could be performed in a different order in FIGS. 5 and 6. In addition, the decision made in decision block 503 may simply be that based on information received from block 502 that it is not possible to determine if a different interval now exists between words.

Once control is received from block 506 or decision block 503 of FIG. 5, block 602 stores samples in the history queue before transferring control to decision block 603. Decision block 603 is responsive to the energy in the samples that are being stored in queue 602 to determine if a silent interval greater than a predefined interval has occurred. If the answer is yes, block 604 sets the silence flag before transferring control to decision block 606. If the answer in decision block 603 is no, control is transferred to decision block 606 which determines if the silence flag is set. If the answer is no in decision block 606, control is transferred to block 609 which transmits a sample from the history queue to the voice coder before returning control back to block 502. Returning to decision block 606, if the answer is yes that the silence flag is set, decision block 607 determines if the low energy detector has detected any voice activity. If the answer is no, control is transferred back to block 502. If the answer in decision block 607 is yes, control is transferred to block 608 which resets the silence flag before transferring control to block 609.

Of course, various changes and modifications to the illustrative embodiment described above will be apparent to those skilled in the art. Such changes and modifications can be made without departing from the spirit and scope of the invention and without diminishing its intended advantages. It is therefore intended that such changes and modifications be covered by the following claims except in so far as limited by the prior art.

What is claimed is:

1. An apparatus for communicating samples from an interface to an encoder, comprising:

a queue for storing samples received from the interface;

an energy detector for identifying samples received from the interface that contain silence and for transmitting a signal to a control circuit identifying a silence interval upon a predefined number of silence samples being identified;

an analyzer responsive to the received samples for adjusting the number of samples stored in the queue and the number of silence samples identified by the energy detector by calculating an average time between words to make the adjustment to the queue and the number of samples; and the control circuit accessing samples from the queue and transmitting the accessed samples to the encoder until the signal from the energy detector is received.

2. A method for reducing bandwidth to transmit voice samples, comprising the steps of: storing voice samples in a queue;

transmitting ones of the stored voice samples from the queue;

detecting for low energy samples in the voice samples;

determining that a continuous interval of low energy samples has occurred;

stopping the transmission of ones of the stored voice samples from the queue upon the continuous interval of low energy samples being determined;

restarting the transmitting step upon the continuous interval of low energy samples ceasing:

analyzing the voice samples to determine a time period between words in the voice samples; and adjusting a capacity of the queue to store voice samples.

3. The method of claim 2 further comprises the step of adjusting a duration of the continuous interval of low energy responsive to the step of analyzing the voice samples to determine a time period between words in the voice samples.

* * * * *